US011530551B2

(12) United States Patent
Gantz et al.

(10) Patent No.: US 11,530,551 B2
(45) Date of Patent: Dec. 20, 2022

(54) EXPANDABLE TENT WITH ADJUSTABLE HEIGHT AND INTERNAL VOLUME

(71) Applicants: Christopher Gantz, Northbrook, IL (US); Peter Gilbert, Pinehurst, NC (US); Kevin Gantz, Laguna Beach, CA (US)

(72) Inventors: Christopher Gantz, Northbrook, IL (US); Peter Gilbert, Pinehurst, NC (US); Kevin Gantz, Laguna Beach, CA (US)

( * ) Notice: Subject to any disclaimer, the term of this patent is extended or adjusted under 35 U.S.C. 154(b) by 0 days.

(21) Appl. No.: 17/127,501

(22) Filed: Dec. 18, 2020

(65) Prior Publication Data

US 2021/0214964 A1 Jul. 15, 2021

Related U.S. Application Data

(60) Provisional application No. 62/949,620, filed on Dec. 18, 2019.

(51) Int. Cl.
*E04H 15/30* (2006.01)
*E04H 15/48* (2006.01)

(52) U.S. Cl.
CPC ..... *E04H 15/48* (2013.01); *E04H 15/30* (2013.01)

(58) Field of Classification Search
CPC ..... E04H 15/30; E04H 15/48; E04H 15/16; E04H 15/38
USPC ..... 135/95
See application file for complete search history.

(56) References Cited

U.S. PATENT DOCUMENTS 2,132,238 A * 10/1938 James ..... E04H 15/30 135/95
2,930,051 A * 3/1960 Kampmeier ..... B60P 3/38 5/119
3,563,257 A * 2/1971 Cummins ..... E04H 15/505 135/131
3,685,061 A * 8/1972 Wray ..... B60P 3/1025 5/119
3,702,617 A * 11/1972 Franzen ..... B60P 3/38 135/88.18
4,072,158 A * 2/1978 O'Brien ..... E04H 15/00 135/117
4,716,918 A * 1/1988 Hayashida ..... E04H 15/48 135/116
4,716,919 A * 1/1988 Griffin ..... E04H 15/001 135/133
4,798,019 A * 1/1989 Sury ..... A01M 31/025 135/901

(Continued)

*Primary Examiner* — Noah Chandler Hawk
(74) *Attorney, Agent, or Firm* — Howard B. Rockman

(57) ABSTRACT

An expandable tent structure with a side wall of mesh or fabric enclosing an internal volume of the tent. The tent has one or more openings in the roof and/or side walls of the tent, and a hatch pivotally attached to the tent. The hatch in one position covers an opening in the roof and/or side wall, and a mesh or fabric structure extends in an accordion-like manner between the hatch and edges of the opening. A plurality of ribs support the mesh or fabric, the ribs being pivotally attached to the tent supporting structure. When the hatch is in its open position, the internal volume of the tent is increased, with the mesh or fabric attached to the hatch and the edges of the opening providing a barrier over the opening against the environment.

4 Claims, 9 Drawing Sheets

(56) References Cited

U.S. PATENT DOCUMENTS

| | | | | | |
|---|---|---|---|---|---|
| 5,283,993 | A * | 2/1994 | Sprung, Sr. | E04H 15/38 | 135/117 |
| 5,301,705 | A * | 4/1994 | Zheng | E04H 15/14 | 135/125 |
| 5,624,199 | A * | 4/1997 | Cheng | A47D 13/063 | 403/100 |
| 6,016,823 | A * | 1/2000 | Hill | E04H 15/001 | 114/351 |
| 6,499,497 | B1 * | 12/2002 | Swetish | E04H 15/32 | 135/117 |
| 2009/0065037 | A1 * | 3/2009 | Hauschild | E04H 15/64 | 135/97 |
| 2014/0090679 | A1 * | 4/2014 | Rolling | E04H 6/04 | 135/88.01 |
| 2016/0362906 | A1 * | 12/2016 | Farris | E04H 15/02 | |

* cited by examiner

EXPANDABLE TENT WITH ADJUSTABLE HEIGHT AND INTERNAL VOLUME

This application claims priority to U.S. provisional patent application Ser. No. 62/949,620, filed Dec. 18, 2019 to the extent allowed by law.

A selectively and easily expanded or contracted tent having an internal space to permit a user's ability to stand up, get dressed more easily, stretch out, enhance the tent's ventilation, or view outside the tent from an elevated position. The value in dressing, stretching or viewing from inside an expanded tent structure is comfort, expediency, and protection from any rain or cold weather.

BACKGROUND OF THE INVENTION

Tents provide a temporary or semi-permanent structure that protects inhabitants or stored items from environmental elements like sun, rain, snow, cold weather, hot weather, insects, infestation, theft, etc. They are often used when camping outdoors or for entertaining. The novel tent described in this application is most beneficial for campers and temporary living quarters.

Tents are popular amongst overnight campers and are typically designed to certain dimensions that accommodate a limited number of people or objects. Tent users must determine the correct size of tent to use based on the capacity to fit a fixed number of people and/or gear. Frequently individuals who are camping will purchase multiple tents, each a different size providing a means for fitting different sized groups of people. Individual and multiple tents are sold to house and sleep fixed numbers of people. Tents are made to fit 1 person, other sized tents are designed to fit 2-3 people, and even larger tents are made to fit 4, 5 and more people. Campers typically must purchase more than one tent as they do not want to have oversized and heavy tents if only accommodating a small number of campers. Additionally most smaller tents have a limited height preventing the user from standing up straight for such things as relaxation, dressing, ventilation and more.

The presently disclosed tent structure provides a simple solution for tent users, providing easy and fast methods for increasing both the vertical and horizontal space within a tent. The presently disclosed tent utilizes a mechanical function allowing the user to expand or reduce the tent size. The tent provides a means of expanding or reducing the tent size from within the tent thus eliminating the need for the user to exit the tent to make the adjustment. The ability to control the tent size at night or during inclement weather, from within the tent is a function unique to the presently disclosed tent.

Others have tried to design tents that require additional coverings such as a vestibule, which utilizes poles and stakes as a method for creating additional room. But those methods generally do not provide much protection from the outside ambient environment. Many tent vestibules do not have a tent floor and rely on the ground as a floor. Generally, tents are set up to a single fixed external size, whereby the only way to expand its size is to add more tent structure, or change to a different size tent. This can be cumbersome, heavy, and, in some instances does not permit an easy method to reversing back to its original smaller size. Tents can be expensive and users must incur the cost of multiple tents which may prevent or limit outside activities, especially during times when the weather is not ideal.

Tents are manufactured in many sizes based on the desired function, the number of persons intended to sleep and/or the environment in which it will be used. Tent manufacturers have tried to solve this problem by adding additional access doors, windows, vents, and rainfly to provide the illusion of an increased space. In some instances they have a vestibule area for creating separation from the living and sleeping quarters. A vestibule is an area where a camper can leave their shoes, wet gear, or store certain things. Generally the vestibule type tent is a permanent structure that cannot be removed. A tent with a vestibule has its base footprint expanded, but it fails to increase the internal living and sleeping space of a tent. While the vestibule feature on a tent is usually an integral structure outside the main living area of a tent it is not weather tight and humans cannot stand erect to full height within a vestibule.

There are certain tall tents that have sufficient height to allow users to stand up to their full or near full height, but these tents are very large and heavy, making them cumbersome and near impossible to carry on hiking trips. Larger tents utilize heavier fabric creating unnecessary weight. Their large surface areas also heighten their exposure to high winds, requiring they have more heavy poles and ropes to keep them grounded.

It would be desirable for a camper to have a versatile tent that can easily adjust to multiple sizes from inside the tent, but exists on a single base footprint. An adjustable tent with one footprint but multiple heights will be light enough for backpacking, more versatile than a conventional fixed size tent, and offer more comfort and functionality. Additionally, it would be advantageous for tents to also expand horizontally increasing the floor space. The presently disclosed tent provides unique methods for expanding both the roof height as well as the floor space. The unique expansion methods provide a means for expanding the internal tent space and remaining weather tight. The vertical expansion of the tent provides a means for the user to stand erect to their full or near full height. The horizontal expansion of the tent provides a fast and simple method for increasing the floor space. This means that a 1 person tent can expand to sleep 2 people. A 2 or 3 person tent can be expanded to sleep 3-5 people, as well as expanding to accommodate ever larger groups of campers.

Because it is not uncommon to experience inclement weather during a camping trip, the present tent provides a means for the camper to reduce the tent size all from within the tent, meaning a user does not have to venture outside the tent to make vertical or horizontal adjustments.

U.S. Pat. No. 5,671,766 describes a tent that can be volumetrically enlarged via a modular addition being connected to the existing tent structure. The expansion is not expediently nor easily adjusted. It is not integral to the main structure, and it is large and heavy, thus not convenient for hiking style campers. U.S. Pat. No. 5,671,766 does not have the benefits of the versatile and expandable tent such as the tent disclosed herein, which provides a means for quickly and selectively changing a tent's internal structure to permit a user's ability to stand up to full or near full height, and then easily collapsing the tent back down in a matter of minutes.

There are other adjustable height tents, or tent concepts such as Patent No. KR20090024974A. This concept, and others like it, are specific to getting a tent stable on uneven terrain. They'll adjust the various tent legs differently to set the tent approximately level to the ground plane. These types of adjustable leg tents are generally not lightweight nor easily adjusted with a single hatch mechanism, unlike the presently disclosed tent, which can easily adjust expansion to adjust to difficult terrain.

A lightweight tent's specifications will vary based on the number of persons it's intended to sleep, but a typical 4 person tent average is 8.5 lbs. There are a multitude of 4 person tents, and they can vary in weight by as much as 3-4 lbs. based on material performance specifications such as watertight integrity, durability, and wind shear, or the designed tent height and the structural components such as rods, stakes and line. The present tent is versatile and expandable and on average adds less than 25-50% more weight for the expandable vertical or horizontal hatch. The present tent adds very little weight achieved through utilization of extremely lightweight materials for the expanding hatch roof and walls.

The present tent has a selective height adjustment, and/or internal volume allowing the user to expand the tent to differing sizes. The present tent's expandable roof permits users to select the desired increase or decrease, and selectivity provides a means for a user to expand open or collapse in as small of increments of 10 percent, all the way to 100 percent. The present tent uses a hinging hatch mechanism that permits a telescoping folding or furling roof that functions in an accordion style. Horizontal expansion operates utilizing the same mechanical method of expansion, by telescoping and unfolding or unfurling the fabric wall of the tent in an accordion style. Expanding the tent fabric to increase wall space also provides a means of covering the floor of the tent with fabric, providing a water resistant or waterproof flow protecting the user from moisture.

The presently disclosed tent's versatile expansion is integral with the main structure. This maintains water tight or weather tight integrity and adds minimal weight for easy backpacking or carrying. The integral vertical or horizontal expansion hatch also provides for easy assembly, disassembly and storage—critical for campers and mobile users. The integral hinge, telescope, accordion or interconnected expandable structure offers intuitive and easy height adjustments, such that a user can stand fully, or near fully to dress, stretch or view, and then can quickly collapse the tent to guard against bad weather such as rain, snow, or high winds.

SUMMARY OF THE INVENTION

An expandable tent structure with one or more side walls made of mesh or fabric enclosing an internal volume of the tent. The tent has one or more openings in the roof and/or side walls of the tent, and a hatch pivotally attached at one end of the hatch to the tent. The hatch in one position covers an opening in the roof and/or side wall of the tent, and a mesh or fabric structure extends in an accordion-like manner between the hatch and three edges of the opening. A plurality of ribs support the mesh or fabric structure, the ribs being pivotally attached to the supporting structure of the tent. When the hatch is in its open position, the internal volume of the tent is substantially increased, with the mesh or fabric material attached to the hatch and the edges of the opening providing a barrier over the opening against weather, debris, and the like.

DETAILED DESCRIPTION

Figure 1A:
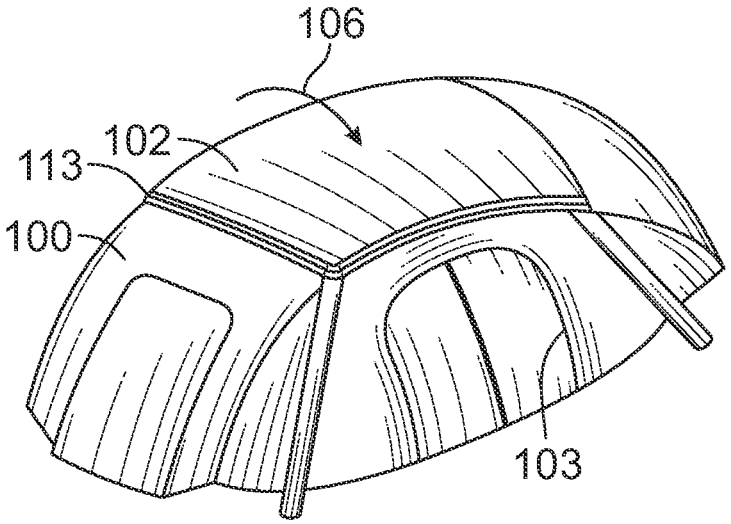
FIG. 1A is a top perspective schematic view of an embodiment of a dome style, elliptical or round tent having an expandable top portion for increasing internal tent space through vertical tent roof hatch expansion, showing the roof hatch in the closed position.
Figure 1B:
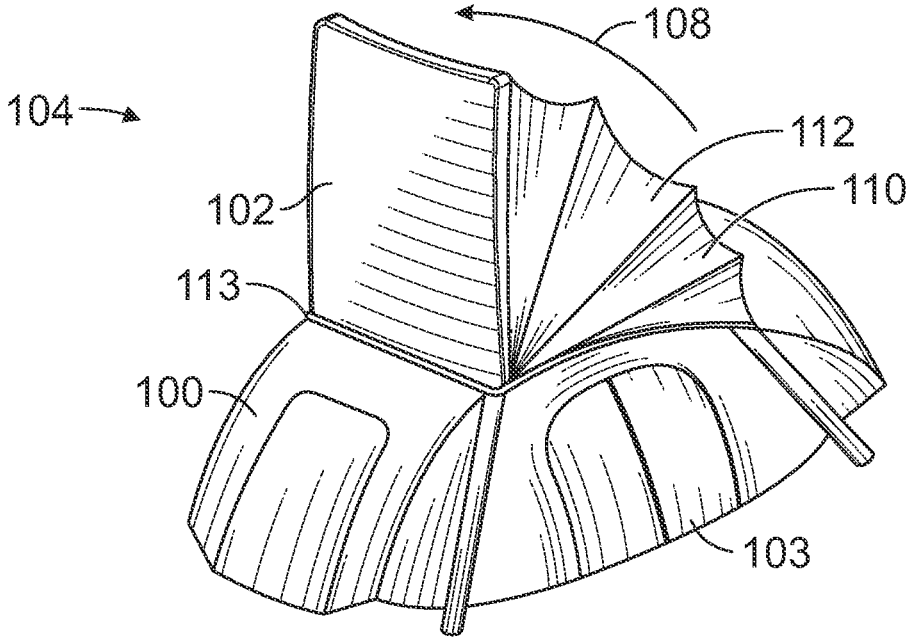
FIG. 1B is a top perspective schematic view of the embodiment of FIG. 1A, showing the roof hatch in the open position.

Referring to FIGS. 1A and 1B, an elliptical, circular, dome or tube shaped tent 100 has a roof hatch portion 102 shown in the closed or down position. An access panel 103 provides entrance into and egress from the interior of tent 100. Directional movement of hatch 102 is shown by arrow 106. FIG. 1B illustrates tent 100 with roof hatch 102 in the open position 104 with the direction of movement to the open position shown by arrow 108. Mesh or solid fabric 110 in an accordion-like array covers the opening in the tent 100 beneath roof hatch 102. Mesh or fabric 110 is supported by ribs 112 of metal, plastic, glass fiber rods, or the like as are known in the art. Ribs 112 are pivotally mounted to tent 100 at axis 113. When roof hatch 102 is moved from the closed position (FIG. 1A) to the open position (FIG. 1B), the vertical height of the interior space of tent 100 is substantially increased, allowing a user to stand in the tent 100, as schematically shown in FIG. 5B.

Figure 2A:
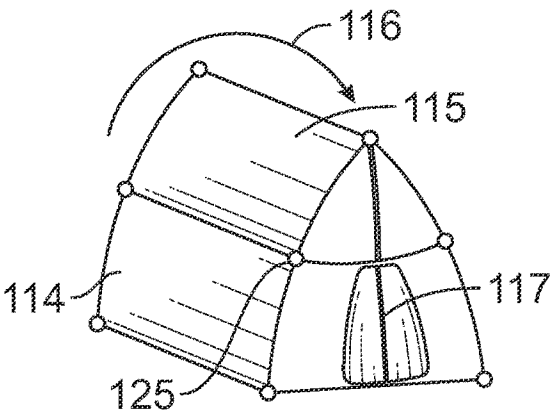
FIG. 2A is a front and side perspective schematic view of an embodiment of a straight walled styled tent having a vertical tent roof hatch expansion system for increasing internal tent space, showing the roof hatch expansion system in the closed position.
Figure 2B:
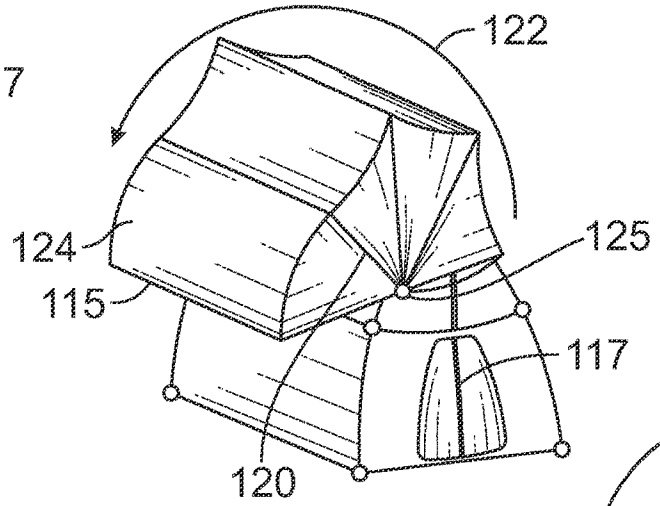
FIG. 2B is a front and side perspective schematic view of the embodiment of FIG. 23A, showing the full roof hatch expansion system in the open position.
Figure 2C:
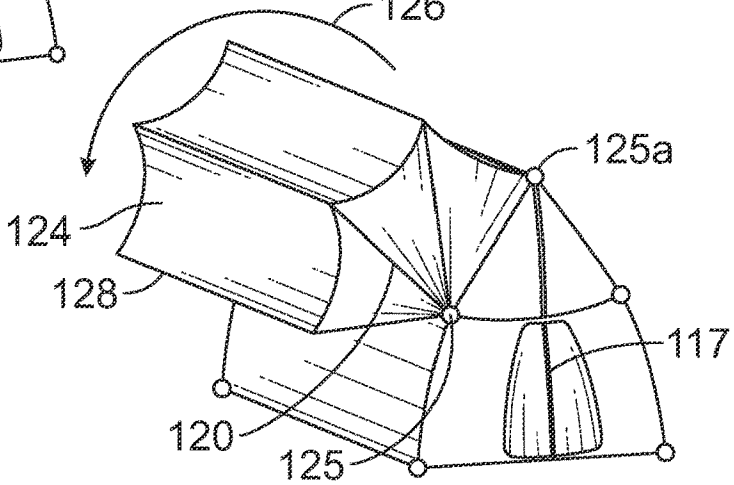
FIG. 2C is a front and side perspective schematic view of the embodiment of FIG. 2A, showing a partial portion of the roof hatch expansion system in the open position.

Referring to FIGS. 2A, 2B and 2C, an A-frame flat walled and roof tent 114 with a roof hatch 115 is shown in the closed or down position in FIG. 2A. The direction of movement of hatch 115 is shown by arrow 116. Access panel 117 provides access into and out of tent 114. FIG. 2B shows roof hatch 115 in the open position 118, with opening directional movement shown by arrow 122. Mesh or fabric 124 in an accordion-like array covers the opening in the tent 114 beneath roof hatch 115. Mesh or fabric 124 is supported by metal, plastic or glass fiber rods 120, or the like as is known in the art. In FIG. 2B, ribs 120 are pivotally mounted to tent 114 at axis 125. When roof hatch 115 is moved from the closed to the open position, the vertical height of the interior space of tent 114 is substantially increased.

In the embodiment shown in FIG. 2C, the roof hatch 115 is only partially open at 128, with ribs 120 and mesh or fabric 124 pivoting from axis 125*a* at the top of tent 114 in the direction shown by arrow 126.

Figure 3B:
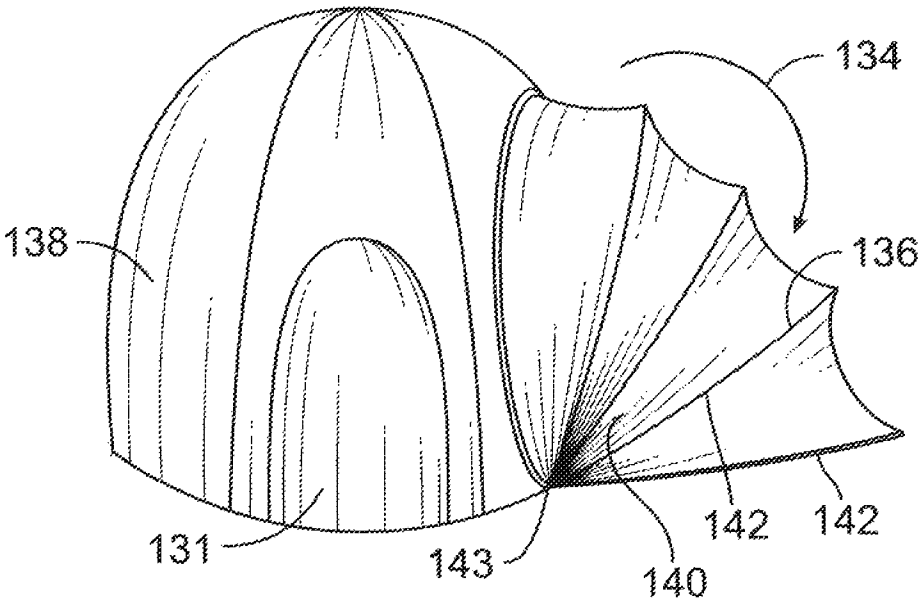
FIG. 3B is a front perspective schematic view of the embodiment of FIG. 3A, showing the wall and floor hatch expansion system in the open position.
Figure 3A:
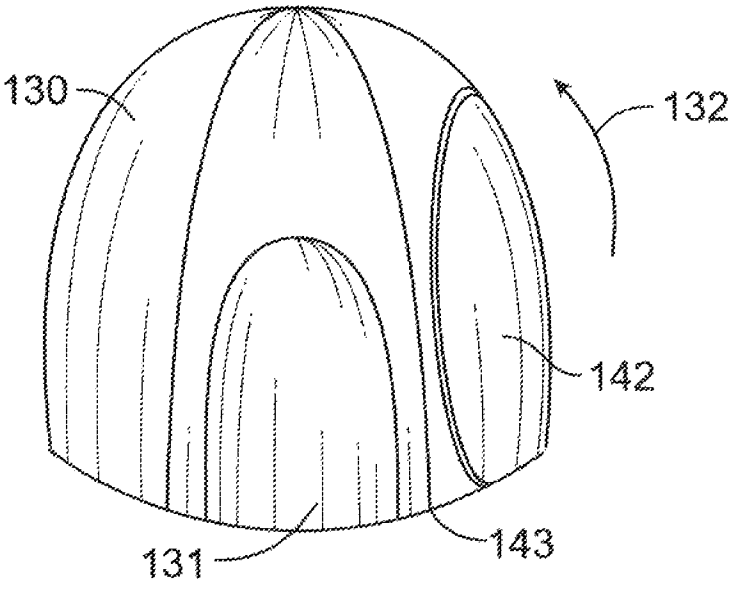
FIG. 3A is a front perspective schematic view of an embodiment of a dome style elliptical or round tent having a horizontal tent wall and floor hatch expansion system for increasing internal tent space, showing the wall and floor hatch expansion system in the closed position.

Referring to FIGS. 3A and 3B, a dome style round or elliptical tent 130 has a side wall hatch 142 shown in the closed or down position. An access panel 131 provides access to and from the interior of tent 130. Directional movement of hatch 142 is shown by arrow 132. FIG. 3B shows the hatch 142 pivoted to the open position, with the direction of movement shown by arrow 134. Mesh or solid fabric 140 in an accordion-like array covers the wall opening beneath hatch 142. Mesh or fabric 142 is supported by ribs 136 of metal, plastic or glass fiber rods or the like as are known in the art. Ribs 136 are pivotally mounted to tent 130 at axis 143. When wall hatch 142 is moved from the closed position (FIG. 3A) to the open position (FIG. 3B) the lateral width of the interior space of tent 130 is substantially increased. The upper surface (not shown) of wall hatch 142 provides additional floor space inside tent 130.

Figure 4A:
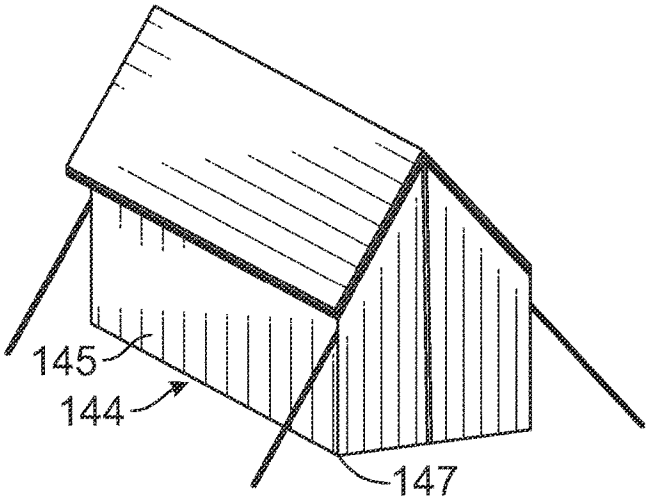
FIG. 4A is a front and side perspective schematic view of an embodiment of a straight or flat walled style tent having a horizontal tent wall and floor hatch expansion system for increasing internal tent space, showing the tent wall and floor hatch expansion system in the closed position.
Figure 4B:
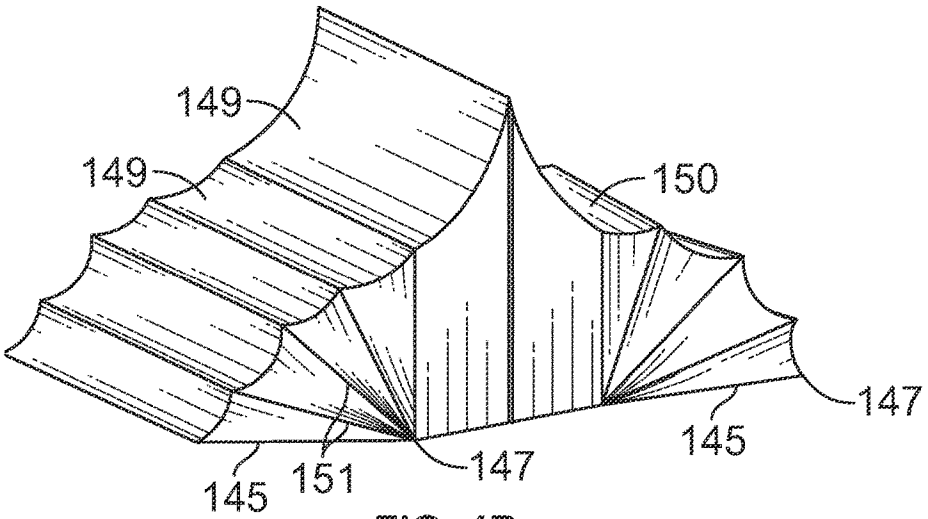
FIG. 4B is a front and side perspective schematic view of the embodiment of FIG. 4A, showing two tent wall and floor hatch expansion systems in the fully open position.
Figure 4C:
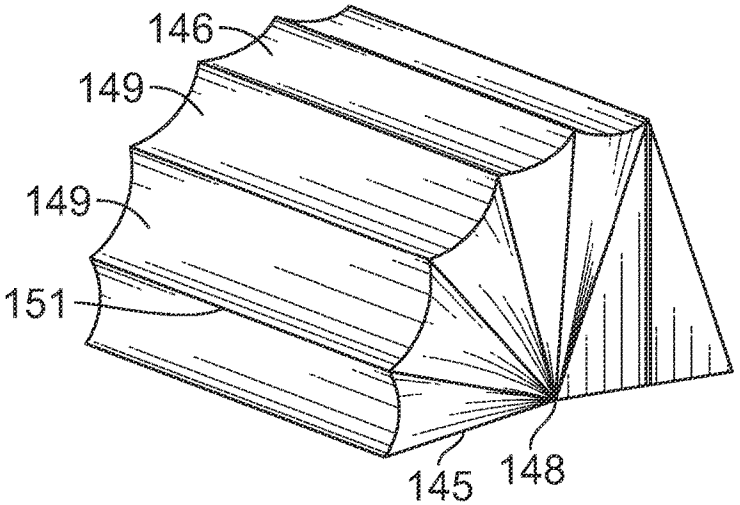
FIG. 4C is a front and side perspective schematic view of the embodiment of FIG. 4A, showing one of the tent wall and floor hatch expansion systems in the open position.
Figure 4D:
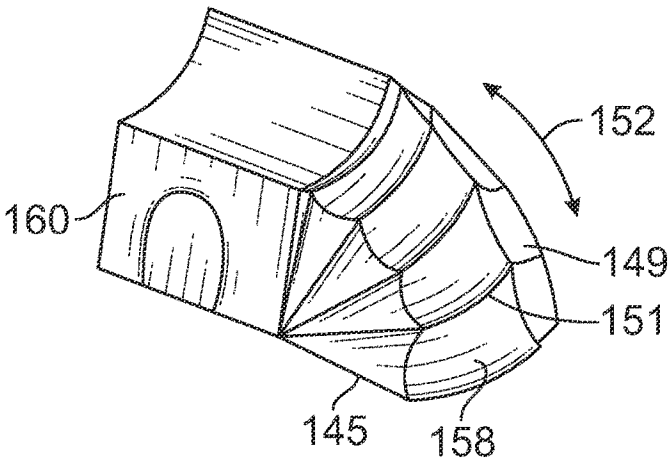
FIG. 4D is a front and side perspective schematic view of the embodiment of FIGS. 4A, B and C, showing a single hatch wall in the open position, the single hatch wall being the opposite of the hatch wall show in in FIG. 4C.

Referring to FIGS. 4A, 4B, 4C and 4D, a straight or flat walled A-frame style tent 144 has one or two side wall hatches 145. Each side wall hatch is pivotally mounted to tent 144 at axis 147. FIG. 4B illustrates tent 144 with two side wall hatches 145 on laterally opposed sides of the tent in their open position 150. Mesh or fabric 149 in an accordion-like array covers the opening in tent 144 beneath hatches 145. Ribs. 151, as described above, support mesh or fabric 149, and ribs 151 are pivotally mounted to tent 144 at axis 147. Movement of wall hatch 145 is depicted by arrow 152 in FIG. 4D FIG. 4C illustrates an A-frame tent 146 with a single side wall hatch 145 open at 148. FIG. 4D shows wall hatch 145 in its open position. As described previously, in the embodiments of FIGS. 4A to 4D, the upper surface of wall hatch 145 (not shown) provides additional floor space inside tent 144.

Figure 5A:
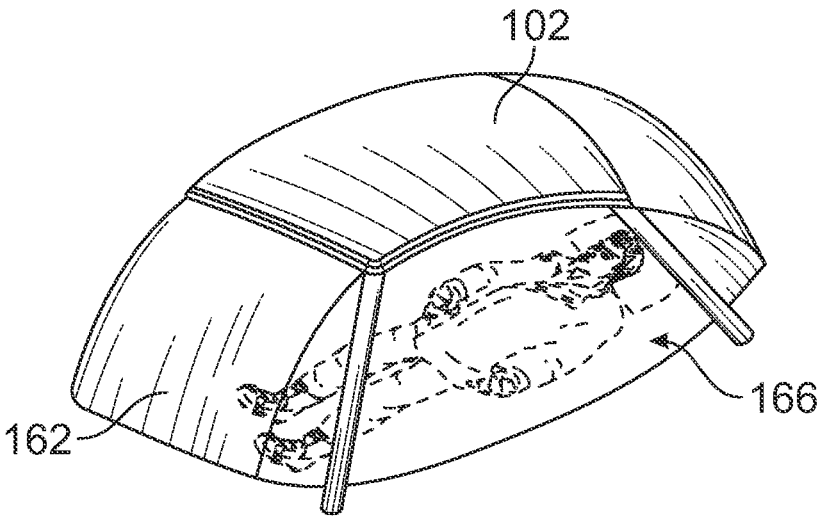
FIG. 5A is a perspective schematic view of the embodiment of FIGS. 1A and 1B, showing a user positioned in the tent when the expandable top hatch is in the closed position.
Figure 5B:
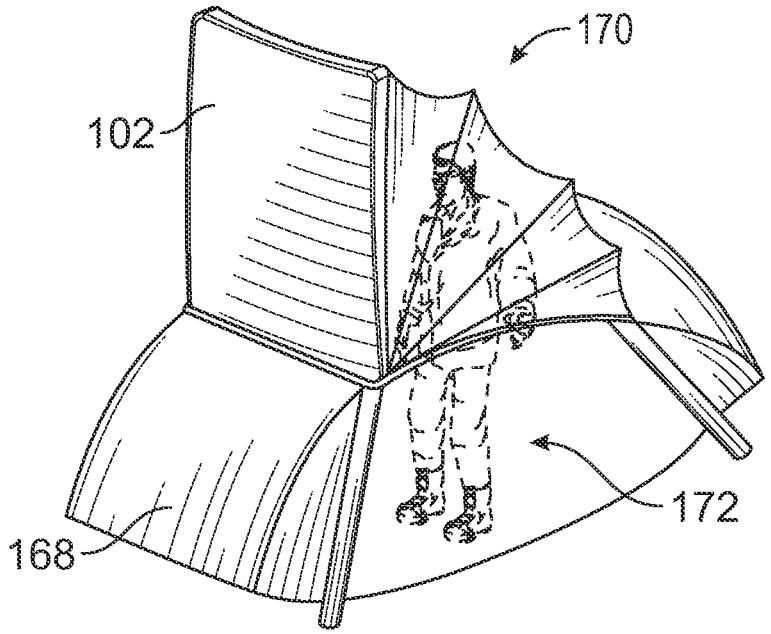
FIG. 5B is a perspective schematic view of the embodiment of FIGS. 1A and 1B, showing a user in an erect position inside the tent when the expandable top hatch is in the open position.

FIGS. 5A and 5B schematically illustrate comparative position of a user of tent 100 with the roof hatch 102 in the closed position. The user 166 has substantially restricted vertical movement in FIG. 5A. In FIG. 5B, hatch 102 is in its open position 170 allowing user 172 to stand erect inside tent 100.

Figure 6:
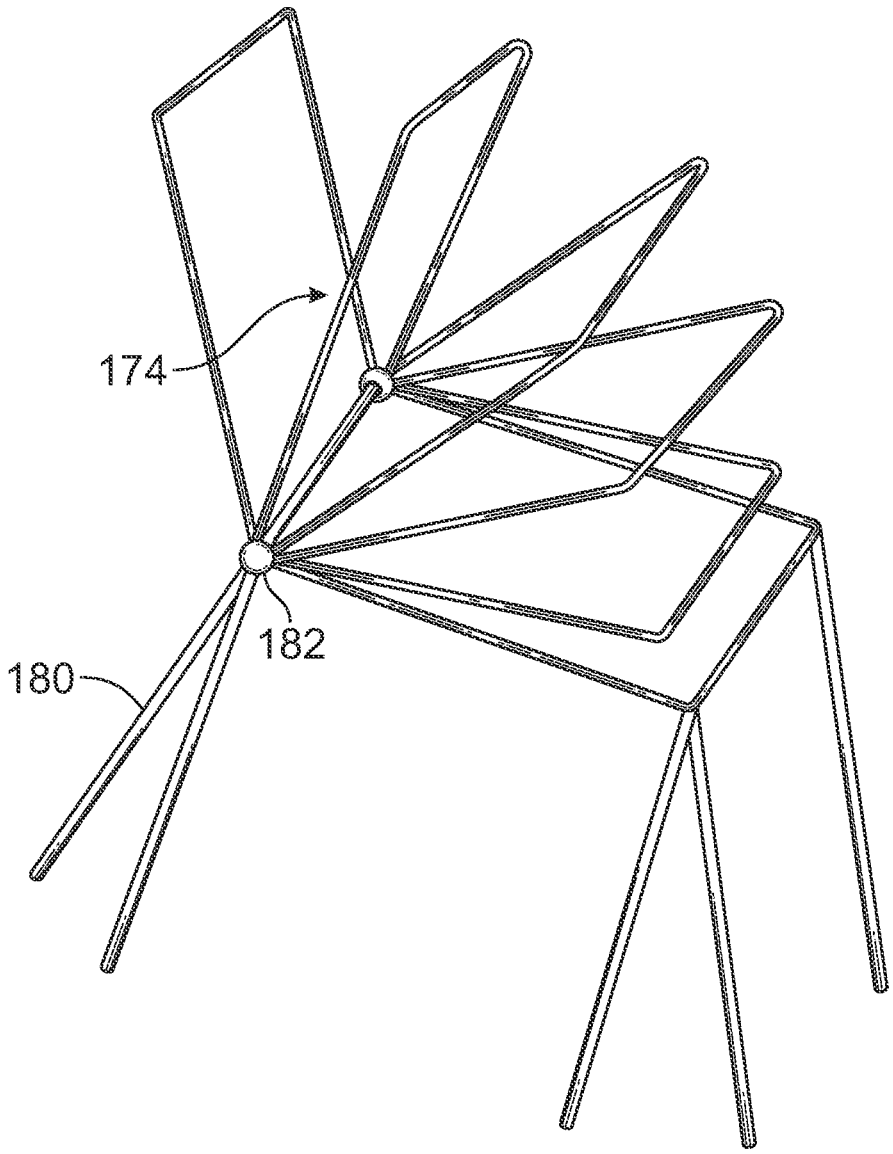
FIG. 6 is a schematic view of an angular mechanical accordion tent expansion and opening support used in embodiments of the presently disclosed tents.

FIG. 6 is a schematic diagram showing the operation of ribs 174 as they pivot about axis 182 of tent 180 in each of the previously described embodiments.

Figure 7B:
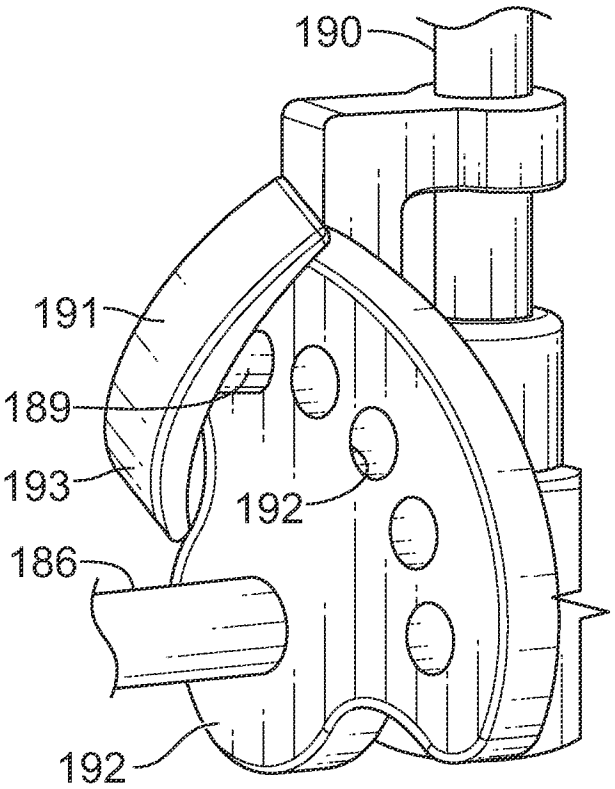
FIG. 7B is rear and side perspective detail view of the mechanism of FIG. 7A.
Figure 7A:
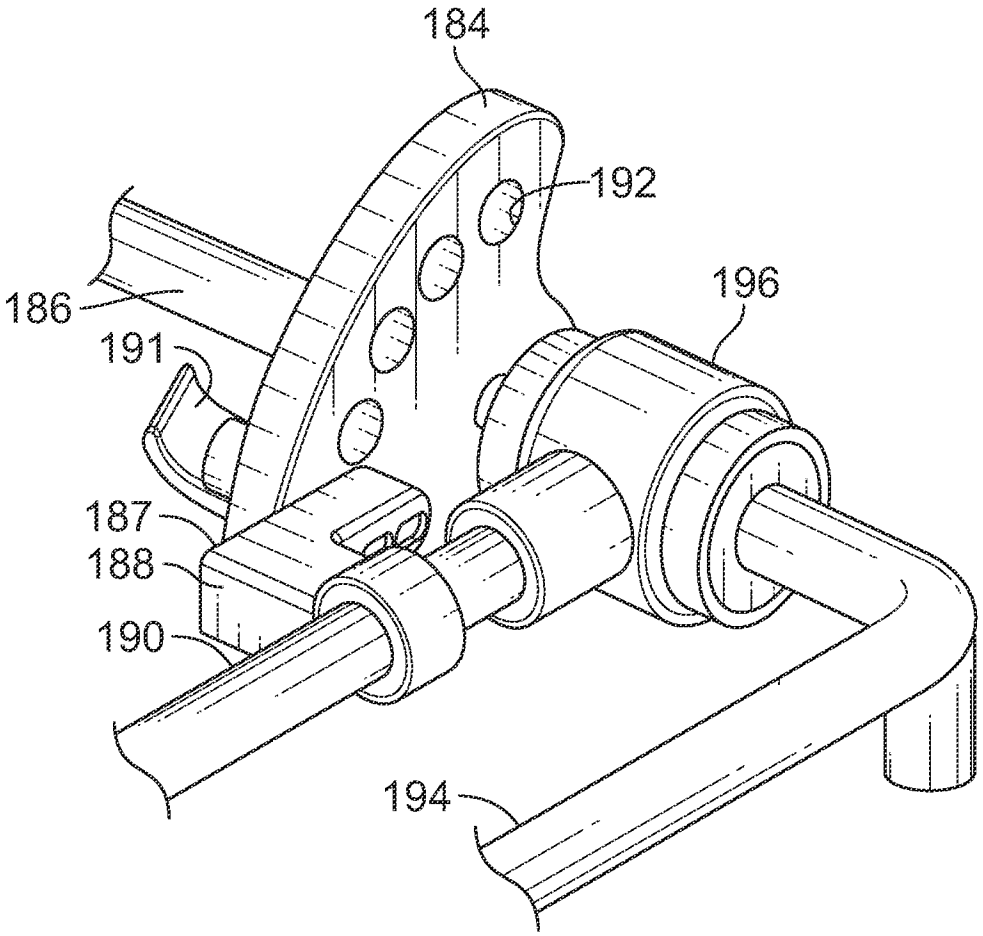
FIG. 7A is a front and side perspective detail view of a mechanism for opening and fixing the position of a roof or wall expansion hatch in the tent embodiments of the present disclosure.

FIGS. 7A and 7B show the internal tent mechanism used for opening and fixing the position of a roof or wall expansion hatch in the fore described embodiments. Flange 184 with a plurality of apertures 192 is fixedly mounted on tent cross-member 186. Rib 190 which supports mesh or fabric (not shown) is pivotally mounted on cross member 186 by means of bearing 196. An extension bracket 188 is fixed to rib 190 having a surface 187 that moves past apertures 192 as rib 190 pivots around cross-member 186. Surface 187 includes an aperture (not shown) that removably receives shaft 189 of stop member 191. When a roof or floor hatch of any of the embodiments of FIGS. 1-4D is desired to be pivoted to an open or closed position, shaft 189 is removed from the aperture in surface 187 by manually grasping handle 193 of stop member 191 and pulling outward, thus freeing rib 190 for movement about cross-member 186. When the ribs 190 are moved to their full open position (FIG. 1B for example), shaft 189 is reinserted into the aperture 192 that is opposite the aperture in surface 187 of bracket 188. Shaft 189 is then reinserted into the aligned aperture 192 and the adjacent aperture in surface 187, thus locking ribs 190 in the position shown in FIG. 1B.

Figure 8A:
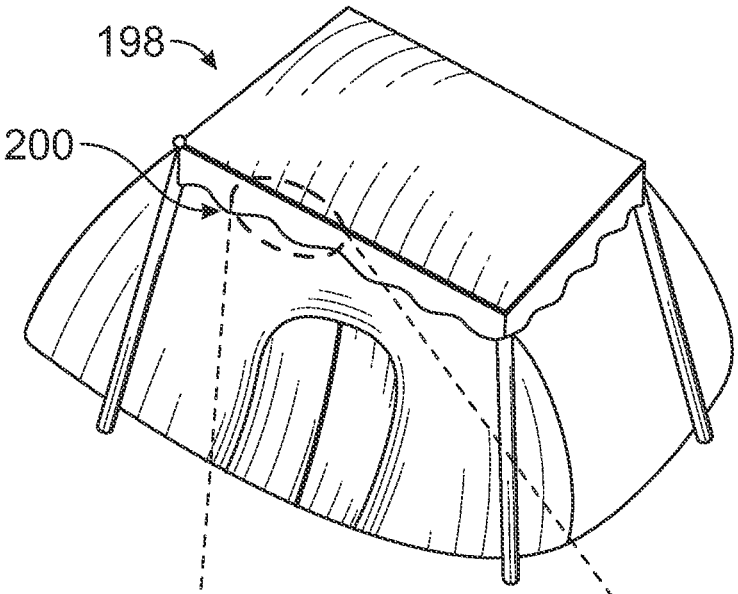
FIG. 8A is a perspective schematic view of the fabric overhang of the tent embodiments of the present disclosure, which overhang prevents water from gathering when the top expansion hatch is closed.
Figure 8B:
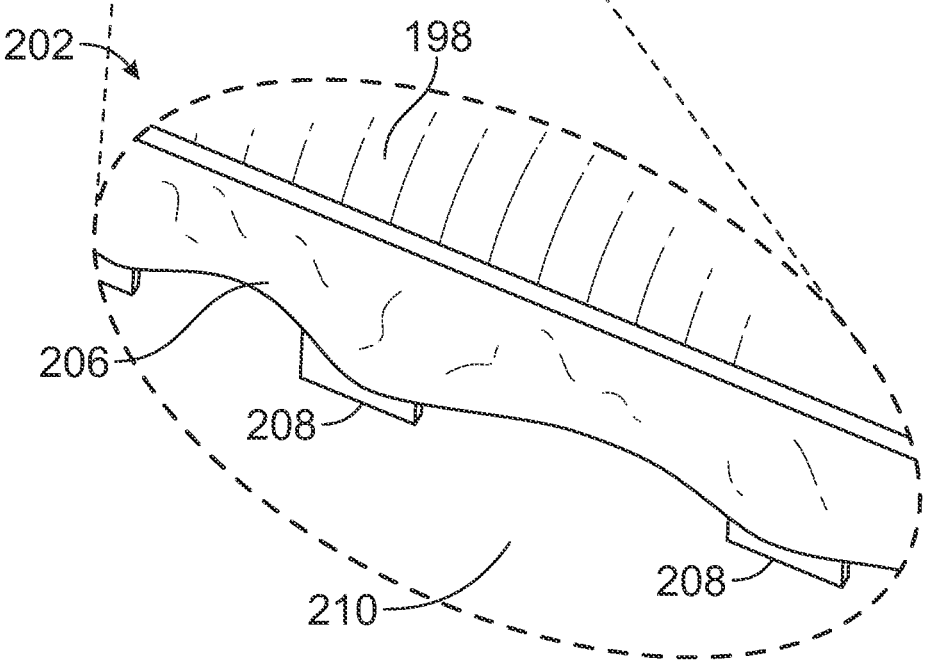
FIG. 8B is a perspective detail view of the fabric overhang structure illustrated in FIG. 8A.

FIGS. 8A and 8B illustrate fabric 206 overhanging the space between roof hatch 198 and tent 199 when hatch 198 is in its closed position to prevent water from gathering between the hatch 198 and the tent roof. 200 designates a detail view of the fabric overhang showing apron 206 attached to the edge of roof hatch 198, with hook and loop fasteners 208 to removably attach apron 206 to the side walls of tent 210. Apron 206 will deflect water away from the space between hatch 198 and the tent roof.

Figures 9A, 9B:
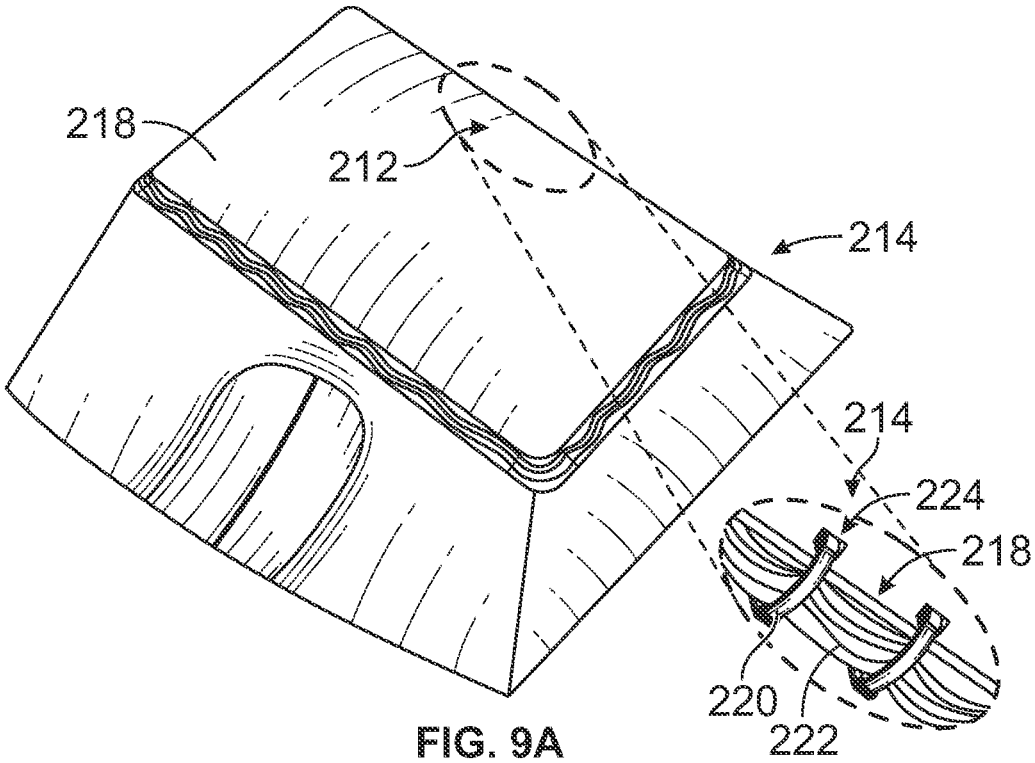
FIG. 9A is a perspective schematic view of a method of storing hatch fabric when a roof hatch or wall hatch of the tent embodiments of the present disclosure are in the lowered or closed position.
FIG. 9B is a detail view of the straps holding the hatch fabric in the illustration of FIG. 9A.

FIGS. 9A and 9B show a structure and method for storing roof and wall hatch fabric when a roof or wall hatch 218 is in its closed or lowered position. As shown in FIG. 9B, a plurality of straps 220 are attached to hatch 218, and extend over rolled-up mesh or fabric material 222. Hook and loop, or other suitable fastener 224 at the end of straps 220 removably adhere to the straps 220 to tent 214, holding mesh or fabric material in the folded position.

While the present disclosure has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An expandable tent, comprising:

a. a tent structure having a side wall made of one of mesh and fabric material, the tent comprising an open internal volume, the side wall including at least one access panel, the access panel providing entrance into and egress from the open internal volume;

b. the tent having a roof portion connected to the side wall, the roof portion and the side wall fully enclosing the internal volume;

c. a hatch portion forming part of the roof portion, the hatch portion connected at one end to the roof portion, the hatch portion extending over an opening in the roof portion, the opening defined by edges of the opening;

d. the one of mesh and fabric material attached to the hatch portion and along at least one edge of the opening;

e. at least one rib pivotally mounted on the tent structure at one edge of the opening, the at least one rib supporting the at least one of mesh and fabric material;

f. the hatch portion moveable between open and closed positions over the opening, the internal volume of the tent structure vertically expanding when the hatch portion is in its open position, the opening of the hatch portion vertically expanding the open internal volume.

2. The expandable tent of claim 1, wherein:

a bracket attached to the at least one rib, the bracket having a first aperture in a surface of the bracket, the bracket rotatably moveable with the at least one rib;

a flange attached to a structural member of the tent, the flange including a plurality of second apertures;

a shaft removably inserted in said first aperture and one of said plurality of second apertures to secure said at least one rib to the structural member of the tent.

3. An expandable tent, comprising:

a. a tent structure having a side wall made of one of mesh and fabric material, the tent comprising an open internal volume, the side wall including at least one access panel, the access panel providing entrance into and egress from the open internal volume, the side wall having a bottom portion and a top portion;

b. the side wall fully enclosing the open internal volume;

c. a hatch portion forming part of the side wall, the hatch portion pivotally connected at one end to the bottom portion of the side wall, the hatch portion extending over an opening in the side wall portion, the opening defined by an edge of the opening in the side wall;

d. the one of mesh and fabric material attached to the hatch portion and along at least one edge of the opening;

e. at least one rib pivotally mounted on the tent structure at one edge of the opening, the at least one rib supporting the at least one of mesh and fabric material;

f. the hatch portion pivotally moveable between open and closed positions over the opening, the open internal volume of the tent laterally expanding when the hatch portion is in its open position.

4. The expandable tent of claim 3, wherein:

a bracket attached to the at least one rib, the bracket having a first aperture in a surface of the bracket, the bracket rotatably moveable with the at least one rib;

a flange attached to a structural member of the tent, the flange including a plurality of second apertures;

a shaft removably inserted in said first aperture and one of said plurality of second apertures to changeably secure said at least one rib to the structural member of the tent.

* * * * *